United States Patent [19]

Kanda

[11] 4,242,615

[45] Dec. 30, 1980

[54] GAS DISCHARGE TUBE DRIVER AND LEVEL SHIFTER CIRCUIT

[75] Inventor: Alvin F. Kanda, Scottsdale, Ariz.

[73] Assignee: Beckman Instruments, Inc., Fullerton, Calif.

[21] Appl. No.: 12,173

[22] Filed: Feb. 14, 1979

Related U.S. Application Data

[63] Continuation of Ser. No. 811,025, Jun. 29, 1977, abandoned.

[51] Int. Cl.[3] ..... H05B 41/16; G09G 3/10

[52] U.S. Cl. ..... 315/169.1; 315/169.2; 315/323; 340/758; 340/802

[58] Field of Search ..... 315/84.6, 169.1, 169.2, 315/169.4, 323; 340/758, 768, 775–777, 802

[56] References Cited

U.S. PATENT DOCUMENTS

| | | | |
|---|---|---|---|
| 3,813,575 | 5/1974 | Webb | 315/167 |
| 3,815,120 | 6/1974 | Kanda | 340/758 |
| 3,842,314 | 10/1974 | Iwakawa et al. | 315/169.4 |

*Primary Examiner*—Eugene R. LaRoche

*Attorney, Agent, or Firm*—R. J. Steinmeyer; F. L. Mehlhoff; William H. May

[57] ABSTRACT

In a circuit for use with a multi-character alphanumeric gas discharge display tube in multiplex operation, each of the character locations is provided with a resistor between its keep-alive cathode and ground and an anode driver transistor connected in series circuit relation with each of the anodes. A switching transistor is connected to each of the resistors to shunt the resistors sequentially in response to receipt of multiplexed logic pulses. The shunting of a given resistor renders the anode driver transistor of an adjacent character conductive in response thereto.

12 Claims, 6 Drawing Figures

GAS DISCHARGE TUBE DRIVER AND LEVEL SHIFTER CIRCUIT

This is a continuation of application Ser. No. 811,025, filed June 29, 1977, now abandoned.

BACKGROUND OF THE INVENTION

The background of the invention will be discussed in two parts:

1. Field of the Invention

This invention relates to circuits for use with a multi-character or digit alphanumeric gas discharge display tube, and more particularly to a circuit for level shifting an anode driver input in such circuits.

2. Description of the Prior Art

In multi-character alphanumeric gas discharge display tubes, one such tube construction includes a plurality of character or digit locations, with each digit location being defined by seven (or more) cathode electrode segments and one common anode, selectively controlled by suitable logic for individually energizing the so-selected segments and anode to display a character, such as a digit. In multiplex operation of such displays, a given period of time is used to individually energize the anode of each digit location, with each digit location being energized for a fraction of the total time period. For example, in a five digit location alphanumeric display tube, each digit location will have the anode energized for approximately one-fifth of the total time, and at the end of this total time the cycle of energization of each digit location will be repeated at a frequency of repetition that is not discernable to the human eye so that each digit will appear to be constantly illuminated. During this "refresh" cycle the voltage levels of the segments are being altered to effect the energization of the proper segments in the addressed digit (anode) position.

In order to operate the gas tube display properly, the anodes of each digit location need to have an "on" potential of approximately 160 to 200 volts and an "off" potential of about 130 volts. The cathodes need an "off" potential of about 80 volts and an "on" potential of close to ground. The shifting of the levels of the anode and cathode potentials as required to operate the gas tube display are accomplished by use of the normal logic signals from a common logic generator which is also utilized to determine which of the electrode segments of each digit location are to be energized. The normal logic signals for these purposes for an "off" condition will be zero volts (or very near ground), and for the "on" logic signal the voltage will be, for example, approximately 15 volts.

A typical driving circuit for a plasma display panel or a gas discharge display tube is shown as described in U.S. Pat. No. 3,842,314 issued Oct. 15, 1974 to Iwakawa et al. The driving circuit shown in that patent is representative of a circuit utilized to energize the electrode segments in response to the logic signals.

In plasma discharge or gas discharge display tubes, since ionization is utilized, by having each digit location properly ionized at a given level by a keep-alive electrode, the individual digit location or cell can be kept from extinguishing as each cell is energized during the multiplexing operation. In a gas discharge tube the firing potential, or the potential necessary to discharge the cell (resulting in illumination) is higher than that necessary to maintain the discharge within the cell once fired.

By utilization of a keep-alive electrode, ionized particles within the cell is shown and described in U.S. Pat. No. 3,801,862 entitled "Plasma Cell Voltage Control Circuit" issued Apr. 2, 1974 to Robert R. Skutt. The means for utilizing the keep-alive cell and the means for energizing it are shown and described in the aforesaid patent.

In a multiplexing operation, where each cell is energized after de-energization of the preceding cell, even with a keep-alive electrode, there is a problem in level shifting an anode driver input of a digit location or cell. Since large potentials are being driven by the use of the lower voltage logic potentials, such level shifting circuits tend to be complicated and require the use of electrical components having unnecessarily high voltage ratings.

The level shifting of the anode potentials, in prior art circuits, have employed means coupled within the anode driver circuit to effect the potential shifting required as the anode potential of each cell is varied during the multiplexing operation. Such means have included, for example, resistor/transistor or capacitance coupled shifters electrically connected between the anode of the cell and the voltage source, which as above mentioned, is utilized to effect an anode potential from an "off" potential of about 130 volts to an "on" potential of approximately 160 to 200 volts. Consequently, with either the resistance coupled shifter or the capacitance coupled shifter, the potentials being controlled are between approximately 130 and 200 volts, thus requiring electrical components that must withstand the maximum voltage being utilized. Other such shifter circuits have employed Zener diodes and gas discharge lamps, in both cases again, coupled in circuit between the anode of the cell and the voltage source. Similarly, the voltage breakdown requirements of the individual electrical components must be selected in accordance with the anode potential requirements.

On the other hand, the cathode drive signals are much lower in potential and as previously stated, the cathodes need an "off" potential of about 80 volts and an "on" potential of close to ground.

Accordingly, it is an object of this invention to provide a new and improved level shifting circuit.

It is another object of this invention to provide a new and improved gas discharge tube driver and level shifter circuit using the tube anode to cathode drop in the level shifting circuit instead of a high voltage transistor, or lower voltage transistor and capacitor.

SUMMARY OF THE INVENTION

The foregoing and other object of the invention are accomplished by providing a gas discharge tube driver and level shifting circuit having a current limiting device such as a resistor coupled between the keep-alive cathode and ground for each digit location or cell in a gas discharge display tube, each resistor being switched in response to multiplexed logic signals to shunt the resistor. The anode of each cell is coupled to a voltage source through an anode driver transistor, with the anode driver transistor of a given cell being rendered conductive in response to the shunting of the cathode resistor in the preceding digit location or cell.

Other objects, features, and advantages of the invention will become apparent from a reading of the specification when taken in conjunction with the drawings in which like reference numerals refer to like elements in the several views.

DESCRIPTION OF THE PREFERRED EMBODIMENT

Figure 1:
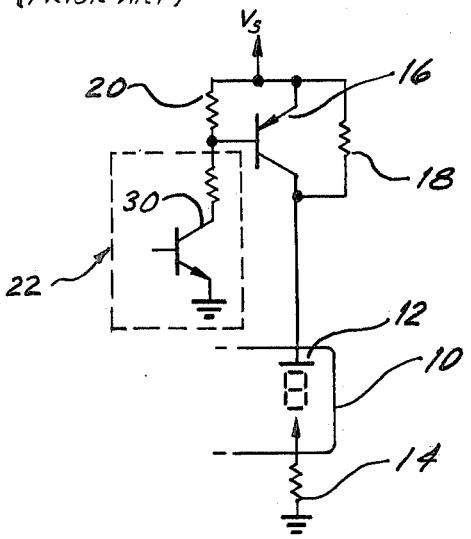
FIG. 1 (PRIOR ART)
FIG. 1 is a schematic diagram of a prior art resistance coupled shifter.
Figure 2:
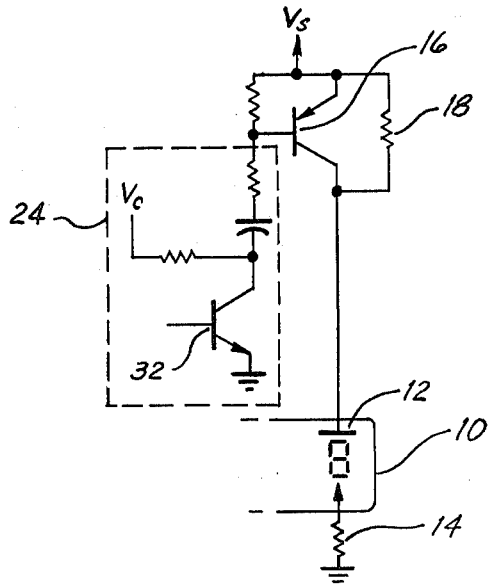
FIG. 2 (PRIOR ART)
FIG. 2 is a schematic diagram of a prior art capacitance coupled shifter.

Referring now to the drawings and particularly to FIGS. 1 through 4, prior art anode driver and anode level shifter circuits are illustrated. In each of these circuits a portion of the tube envelope 10 is illustrated with a single digit location within the tube having an anode 12 and cathode coupled through a resistor 14 to ground. With respect to FIGS. 1 through 4, the same reference numeral will be utilized for those portions or components of the circuit which are identical in all four figures. Each anode 12 within the envelope 10 has an anode driver transistor 16 having the emitter thereof connected to a suitable voltage source $V_s$, with the collector of transistor 16 being connected directly to the anode 12. The collector and emitter are interconnected by a suitable bias resistor 18 while a second bias resistor 20 interconnects the emitter and base of transistor 16.

Figure 3:
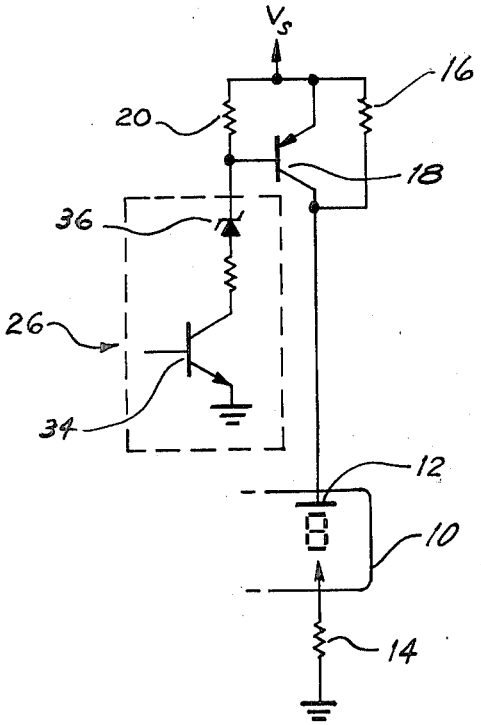
FIG. 3 (PRIOR ART)
FIG. 3 is a schematic diagram of a prior art Zener diode coupled shifter.
Figure 4:
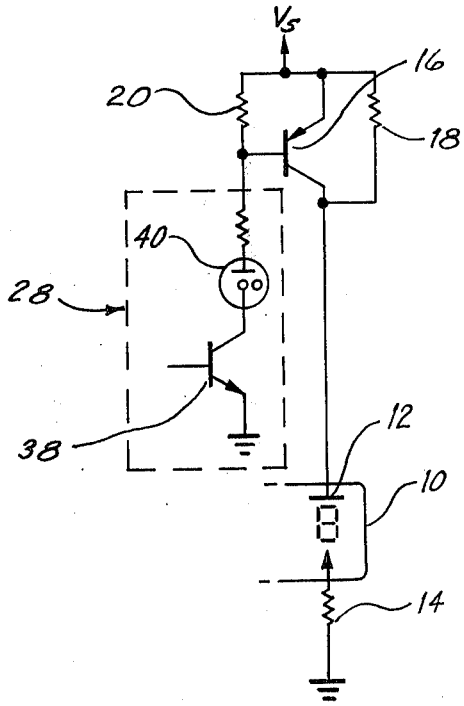
FIG. 4 (PRIOR ART)
FIG. 4 is a schematic diagram of a prior art gas discharge lamp coupled shifter.

Also connected to the base of transistor 16 are suitable control means which effect the switching of the transistor 16 to control the voltage potential on anode 12, the control means in each of the figures being shown in dotted lines and generally designated 22, 24, 26 and 28 for FIGS. 1 through 4, respectively. In FIG. 1 the control means 22 is a resistance coupled transistor 30 connected between the base of transistor 16 and ground. In this particular configuration the breakdown voltage requirements of transistor 30 must be high, inasmuch as the collector of transistor 30 must be able to withstand the voltage applied to the anode. Similarly in FIG. 2, the control means 24 employ a capacitance coupled transistor 32 as a level shifter to control the anode voltage, the transistor 32 being coupled in the base circuit of transistor 16. Again, as in the control means 22 of FIG. 1, the capacitor within the control means 24 of FIG. 2 must have a high breakdown voltage value in order to withstand the total supply voltage $V_s$. In addition, the capacitor is an additional component, and must be sufficiently large to provide the base drive to transistor 16 for the entire digit time. FIGS. 3 and 4, likewise, utilize, respectively, a Zener diode coupled shifter control means 26 and a gas discharge lamp coupled shifter within the control means 28 to effect the voltage changes on the anode 12. In FIG. 3, the transistor 34 has the collecter thereof coupled through a Zener diode 36 to the base of transistor 16 while in FIG. 4, the transistor 38 of control means 28 is coupled through a gas discharge tube 40 to the base of transistor 16. By utilization of the circuits of FIGS. 3 and 4, the voltage breakdown requirements of the level shifter switch are reduced but the number of components used to accomplish the purpose are increased over the control means circuit 22 shown in FIG. 1. Also, the circuit of FIG. 3 uses a high voltage Zener diode 36. In either event, additional cost is required for the additional components, or the higher rated components required, as the cse may be. In all four circuits shown in FIGS. 1 through 4, the level shifting of the voltage on anode 12 results from a logic input of a relatively low level being applied to the base of the transistor associated with each of the control means 22, 24, 26 and 28 resulting in switching of the transistor 16 to result in the required potential change on anode 12 of the gas discharge tube 10.

Figure 5:
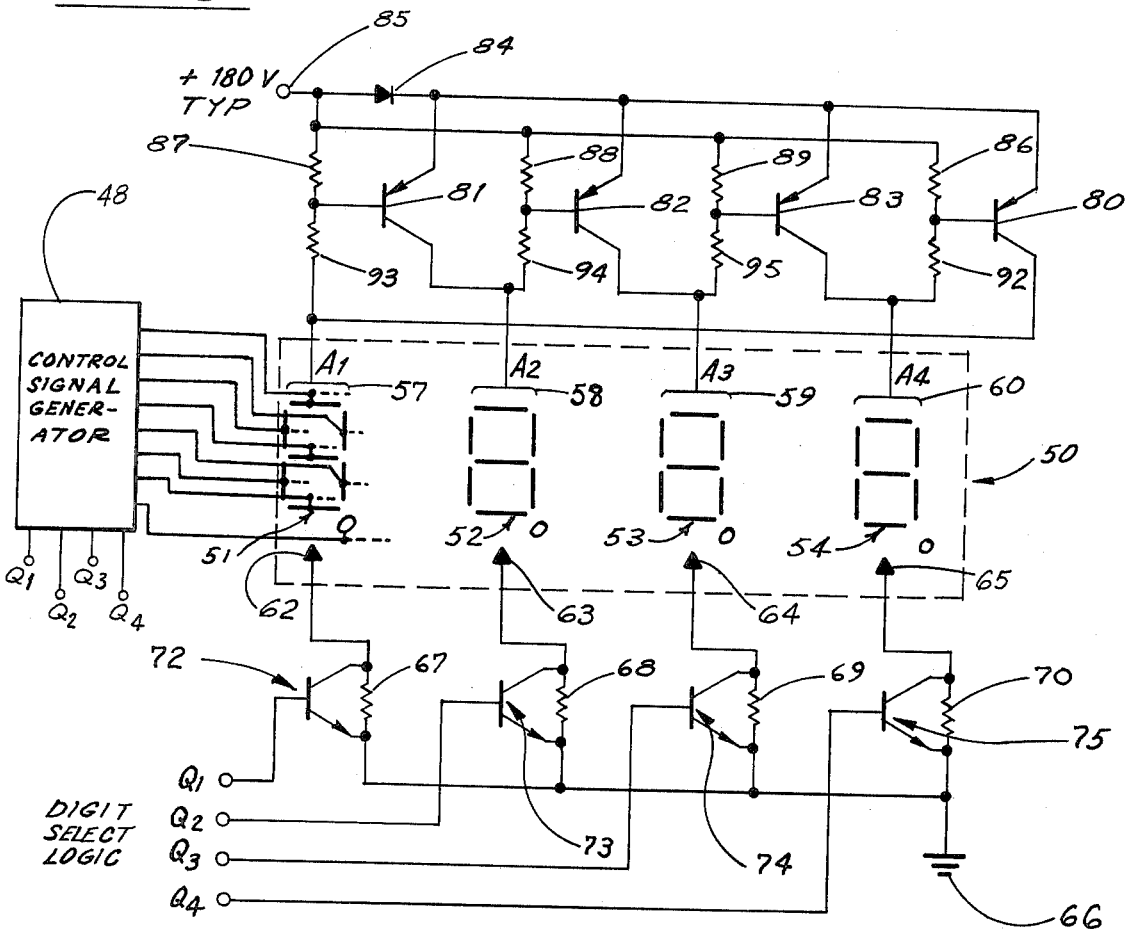
FIG. 5 is a schematic diagram of the gas discharge tube driver and level shifter circuit according to the invention.

Referring now to FIG. 5, the gas discharge tube driver and level shifter circuitry will be discussed. Enclosed in dotted lines and generally designated 50 is an alphanumeric gas discharge display tube having four alphanumeric character locations or cells 51–54, with each cell having the conventional seven or more (depending on decimal points, commas, etc.) electrode segment configuration, with each of the segments being suitably selectively energized to create the character displayed. The means for energizing the digit segments do not form a part of the instant invention, but in conventional fashion as described in the above referenced U.S. Pat. No. 3,842,314, each of the segments are suitably controlled by logic to provide the display of digits. As illustrated, a suitable control signal generator 48 has a first set of eight output leads connected to the digit locations and a second set of four digit select logic output leads designated Q1–Q4. Each of the first seven leads of the first set is connected to a given one of the seven cathode electrode segments of all digit locations or cells. For example, the uppermost lead is shown in solid line connection with the uppermost horizontal cathode electrode segment for the first digit location 51. The connection to the corresponding electrode segment in each of the subsequent digit locations 52–54 have been eliminated so as not to unduly complicate the drawings. Similarly, the correspondingly positioned electrode segments for all digit locations are interconnected to receive signals or be addressed, by the control signal generator 48. The eighth lead of the first set of output leads interconnects the common electrodes associated with the cathode electrode segments of each cell. Logic pulses from the control signal generator 48 then control the display of the characters or digits.

Each of the cells 51–54 has an anode 57–60, respectively, as well as keep-alive cathodes 62–65, respectively. Connected between each of the keep-alive cathodes 62–65 and ground 66 are current-limiting resistors 67–70, respectively, with each of the resistors being adapted to be bypassed or shunted by identical transistor switches 72–75. The cathode 62 of cell 51 is connected to the collector of a transistor 72 which has its emitter connected to the other side of the resistor 67 which is at ground potential 66. Similarly, the cathode 63 of cell 52 has the resistor 68 thereof connected to a transistor 73; cathode 64 of cell 53 has a resistor 69 thereof connected to transistor 74; and resistor 70 connected to cathode 65 of cell 54 is identically connected to transistor 75. The base of each of the transistors 72–75 are adapted to receive suitable logic signals from control signal generator 48 which is also utilized to drive the segments of each of the cells. These inputs are designated Q1, Q2, Q3 and Q4 for each of the transistors 72–75, respectively. These inputs will be discussed hereinafter with respect to the wave forms of FIG. 6.

The anode driver circuitry includes PNP transistors 80–83 which have the collectors thereof direct coupled to the anodes 57–60, respectively, of cells 51–54, respectively. The emitters of transistors 80–83 are coupled together and to the cathode of a common biasing diode 84, the anode of which is connected to a positive source ($V_s$) of voltage 85. Each of the transistors 80–83 is suitably biased by means of first resistors 86–89 connected between the voltage source 85 and the base of transistors 80–83, respectively, and second resistors 92–95, respectively, connected between the base and the anodes 57–50, respectively.

The connection of the transistor switches 80–83 for the anode driver circuitry is such that the base of a given transistor is coupled to respond to the anode voltage potential condition existing in the preceding digit location or cell. For example, transistor 81 which is coupled to control the anode 58 of the second digit location or cell 52 has the base thereof coupled to respond to an anode potential change existing in the first location or cell 51. When an input signal is applied to terminal Q1 transistor 72 conducts thereby shunting resistor 67 in the keep-alive cathode circuit of cell 51. This drops the keep-alive cathode voltage, and consequently the voltage on anode 57 of cell 51. The current increase caused by the higher voltage across series resistors 87 and 93 is sensed by the base of anode driver transistor 81 which is coupled to the anode circuit 58 of the second digit location 52.

Figure 6:
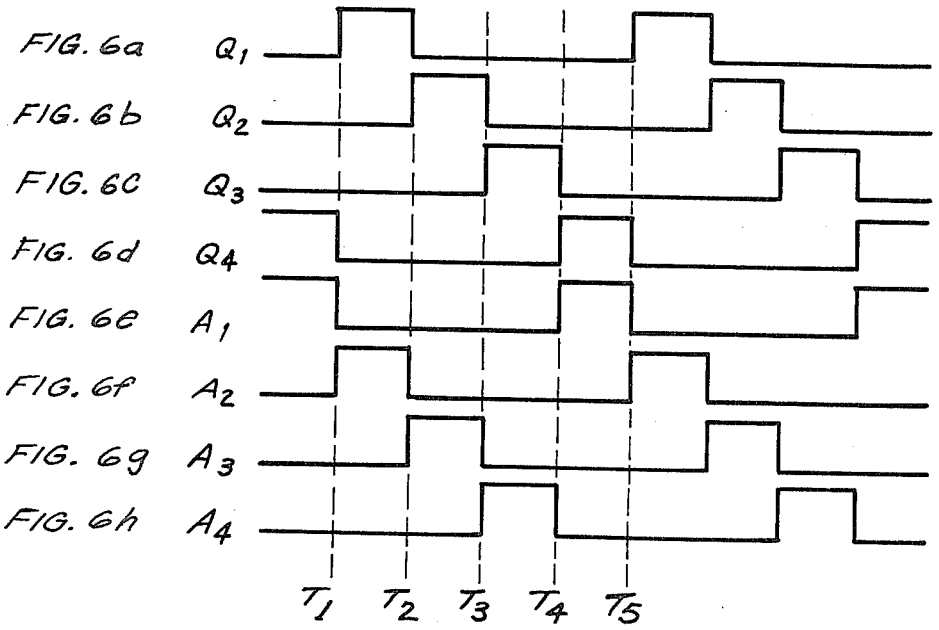
FIG. 6 graphically illustrates wave forms (*a*) through (*h*) used and resulting in the circuit of FIG. 5.

The operation of the circuit of FIG. 5 will now be discussed with reference to the wave forms of FIG. 6. FIGS. *6a–d* show in graphical form the logic inputs (designated Q1–Q4) to transistors 72–75 which are the keep-alive cathode driver transistors. FIGS. *6e–h* show the resulting wave forms (designated A1–A4) corresponding to the digit location (or cell) voltages appearing at the anodes 57–60 of the cells 51–54, respectively. The various wave forms are aligned vertically with respect to a horizontal time scale to indicate the "on" and "off" conditions with respect to each time increment of both the cathode driver inputs (FIGS. *6a–d*) and the outputs resulting therefrom (FIGS. *6e–h*) which are the voltages supplied to the anodes 57–60.

With reference to cell 51, which is the first digit location, transistor 72 is the keep-alive cathode driver transistor and with transistors 72 and 80 in the non-conductive state, the value of resistors 87, 93 and 67 determine the current in the first cell 51 circuit for a given supply voltage and tube voltage versus current characteristic. A typical value of supply voltage would be approximately 180 volts appearing at terminal 85 and with transistor 72 "off," current flows from the supply voltage at terminal 85 through resistor 87, through resistor 93 into anode 57, out of keep-alive cathode 62 and through resistor 67 to ground. The values of the resistors are selected such that the voltage drop across resistor 87 is lower than the sum of the forward voltage of diode 84 plus the voltage drop across the base to emitter junction of transistor 81, thus maintaining the transistor 81 biased in an "off" condition. When a logic pulse is applied to terminal Q1, this pulse is applied to the base of transistor 72 which turns it "on," thus shunting or shorting out resistor 67 resulting in the keep-alive cathode 62 going essentially to ground. Since the voltage versus current characteristic of the gas tube shows substantially no change in voltage for this change in current, the potential of anode 57 drops by the amount that was formerly across resistor 67. The current through resistor 87 thereby increases, thus increasing the voltage drop across resistor 87 until it is clamped by diode 84 and the base to emitter junction of transistor 81 then turns transistor 81 "on." The anode 58 for the second digit location or cell 52 is thereby connected in the emitter to collector circuit of transistor 81. With transistor 81 conductive, a circuit is completed from voltage source 85 through diode 84 through the emitter to collector of transistor 81 through anode 58 through cell 52. The voltage now appearing at anode 58 is equal to the supply voltage appearing at terminal 85 minus the negligible voltage drop across diode 84 and the emitter to collector of transistor 81.

This is shown graphically in FIGS. *6a* through *6f*. When the logic input is applied at terminal Q1, this pulse appears at time T1 when the pulse goes high resulting in a corresponding high voltage as shown in FIG. *6f* at time T1 at the anode 58 of cell 52. At time T2, when the pulse appearing at input terminal Q1 goes low, a logic pulse is applied to input terminal Q2 (FIG. *6b*) resulting in the anode voltage on anode 58 going low (FIG. *6f*) and the voltage appearing at anode 59 of cell 53 going high (FIG. *6g*). At time T3, the input pluse Q2 goes low as does the anode voltage on A3 while simultaneously the input voltage Q3 goes high with a resultant voltage going high on anode 60 (FIG. *6h*). At time T4, the input pulse Q4 goes high resulting in transistor 75 being rendered conductive thereby effecting conduction of transistor 80 which has the collector thereof coupled to the anode 57 of the first digit location or cell 51 with anode 57 going high as indicated by wave form A1 shown in FIG. *6e*. When the input pulse Q4 goes low, the cycle then repeats itself. The time between the vertical line T1 and the later vertical line T5 represents one refresh cycle of the alphanumeric display 50 wherein each digit location or cell is "on" for approximately one-quarter of the time.

By comparison to the prior art circuits illustrated in FIGS. 1 through 4, each of the circuits is provided with a resistor 14 between the keep-alive cathode and ground, with the anode driver level shifting being accomplished by the control means 22, 24, 26 and 28 with all these control means being in the anode driver circuit. By utilizing this resistor as shown in FIG. 5 in conjunction with keep-alive cathode driver transistors 72–75, these transistors in the cathode circuit are operating at much lower voltage levels to generate the resultant higher voltage changes required in the anode circuit, thus requiring transistors of much lower voltage ratings. Additionally, due to the uncomplicated arrangement and using the inherent anode to keep-alive cathode drop within the cell 51, for example, to drive the anode 58 of an adjacent digit, the number of electrical components required to accomplish the result are reduced.

In the particular circuit illustrated in FIG. 5, the necessary condition for transistor 72 "off" and transistor 81 "off" is:

$$I_{R87}(\text{off}) \times R_{87} < V_{BE1} + V_D$$

where $I_{R87}(\text{off}) = (V_S - V_T)/(R_{87} + R_{93} + R_T + R_{67})$ $I_{R87}$ = Current through resistor 87

$R_{87}$ = resistance of resistor 87

$R_{93}$ = resistance of resistor 93

$R_{67}$ = resistance of resistor 67

$V_S$ = supply voltage $V_T$=equivalent tube voltage $R_T$=equivalent tube resistance $V_{BE1}$=base-emitter drop of transistor 81

$V_D$=forward voltage of diode 84

The necessary condition for transistor 72 "on" and transistor 81 "on" is:

$$I_{R93}\,(\text{on}) - \frac{(V_{BE1} + V_D)}{R_{87}} > \frac{I_{anode\,1}}{B_1}$$

$$\text{where } I_{R93}\,(\text{on}) = \frac{V_S - V_D - V_{BE1} - V_T}{R_{93} + R_T}$$

$B_1$=current gain of transistor 81.

The above equations with respect to transistors 72 and 81 are correspondingly applicable to the following stages for each digit location. While there has been shown and described a preferred embodiment of a gas discharge tube driver and level shifter circuit it is to be understood that other adaptations and modifications may be made within the spirit and scope of the invention.

What is claimed is:

1. In a gas discharge display apparatus including a plurality of cells connected for multiplex operation, each cell having an anode and at least two cathodes, the combination comprising:

a current-limiting device connected in series circuit relation with each of said cells to one of said at least two cathodes;

anode driver means coupled in circuit relation with each of said anodes;

means for sequentially shunting each of said current-limiting devices; and means responsive to the shunting of a current-limiting device for energizing the anode driver means of another cell to vary the potential on the anode of said another cell.

2. The combination according to claim 1 wherein said means for sequentially shunting said current-limiting devices includes a switching transistor in parallel circuit relation with each said current-limiting device and a logic generator sequentially applying pulses to each of said transistors.

3. The combination according to claim 2 wherein each of said current-limiting devices is a resistor.

4. The combination according to claim 3 wherein said anode driver means includes a transistor having the emitter to collector circuit thereof coupled in series relation between a voltage source and the anode.

5. The combination according to claim 4 wherein the base of said anode driver transistor is coupled in circuit relation with the anode of said given cell.

6. The combination according to claim 5 wherein the emitters of all of said anode driver transistors are coupled together and a common biasing diode is connected in series between the voltage source and the emitters.

7. A gas discharge display device comprising:

an envelope containing an ionizable gas;

a plurality of character positions within said envelope and having an anode and at least two display cathodes;

means for driving said anodes;

a separate independent nondisplay cathode in each character position; and means for driving said nondisplay cathode to control the current through said character position of said nondisplay cathode and for controlling in cooperation with said anode driving means the activation of the anode of another character position.

8. A gas discharge display device as defined in claim 7, wherein said driving and controlling means operates at logic level voltage.

9. A gas discharge display device as defined in claim 7, wherein said nondisplay cathode is a keep-alive cathode, the anode to said keep-alive cathode potential of said character position will shift the level of voltage of said another character position.

10. A gas discharge display device as defined in claim 7, wherein said nondisplay cathode driving means comprises a transistor coupled in series with said nondisplay cathode.

11. A gas discharge display device as defined in claim 10 and additionally comprising a resistor coupled in parallel with said nondisplay cathode transistor.

12. A gas discharge display device comprising:

an envelope containing an ionizable gas;

a plurality of character positions within said envelope, each of said character positions having an anode and at least two display cathodes;

circuit means for driving said anodes;

a nondisplay cathode in each character position;

means for driving said nondisplay cathode; and means for connecting said anode circuit driving means in such a manner that one of said character positions functions as a voltage level shifter to activate the anode of an adjacent character position.

* * * * *